US005529126A

United States Patent [19]

Edwards

[11] Patent Number: 5,529,126

[45] Date of Patent: Jun. 25, 1996

[54] VALVE CONTROL APPARATUS

[75] Inventor: Jeffrey C. Edwards, Dyce, Scotland

[73] Assignee: Expro North Sea limited, Reading, England

[21] Appl. No.: 331,008

[22] Filed: Oct. 28, 1994

Related U.S. Application Data

[63] Continuation of Ser. No. 30,452, May 3, 1993, abandoned.

[30] Foreign Application Priority Data

Oct. 3, 1990 [GB] United Kingdom ..... 9021488

[51] Int. Cl.[6] ..... E21B 23/00

[52] U.S. Cl. ..... 166/331; 166/240; 166/386

[58] Field of Search ..... 166/386, 240, 166/331

[56] References Cited

U.S. PATENT DOCUMENTS

| | | | |
|---|---|---|---|
| 3,703,104 | 11/1972 | Tamplen | 166/331 X |
| 4,913,231 | 4/1990 | Muller et al. | 166/250 |
| 5,020,592 | 6/1991 | Muller et al. | 166/187 |

*Primary Examiner*—Terry Lee Melius
*Attorney, Agent, or Firm*—Synnestvedt & Lechner

[57] ABSTRACT

After the drilling of an oil well bore there is normally carried out testing using a test tool string. Following completion of the test, the test tools must be shut down, and the test string removed. It is an advantage if the string incorporate some means of isolating the upper portion of the its tubing, and of subsequently providing a communication route between this tubing and the annulus, so that tubing-contained well liquid above the test string can be circulated out of the tubing before it is raised to the surface. Previous apparatus suggested for this purpose performs quite satisfactorily, but commonly is a "one-off" system; once activated, the several operations resulting therefrom are irreversible, and the tool cannot easily be put back into the initial state. The present invention proposes a solution to this problem, by providing a novel valve arrangement that enables the opening and closing of the test string circulation valve, and—when that valve is closed—the opening and closing of the tubing isolating valve, as many times as desired, a complete cycle of operations also being repeatable at will. To attain this end the invention employs a number of inventive arrangements and systems. The invention proposes the use of a J-slot indexer to control the operation of a tool, the slot being in the form of a closed loop track, and there is a second closed loop track part of which is in common with the first track, the two tracks controlling two different tool mode operations.

17 Claims, 8 Drawing Sheets

VALVE CONTROL APPARATUS

This is a continuation of application Ser. No. 08/030,452, filed on May 3, 1993, now abandoned, which is the National Phase filing of International application PCT/GB91/01679, filed on Sep. 30, 1991, and which designated the U.S.

This invention relates to valve control apparatus, and concerns in particular a multi-operation valve control apparatus usable as a resettable safety circulating valve in a downhole well test string.

Whether at sea or on land, the first stages in the production of a new hydrocarbon well—an oil well—are the drilling of the well bore itself through the various formations within the earth's crust beneath the drilling rig, followed by "casing" (the introduction and cementing into position of piping which will serve to support and line the bore) and the placing in the bore, at the depth of a formation of interest, of a device known as a packer, into which inner tubing (of smaller diameter than the casing) can subsequently be lodged.

The next work carried out is normally some programme of testing, for the purpose of evaluating the production potential of the chosen formation. The testing procedure usually involves the measurement of downhole temperatures and pressures, in both static and flow conditions (the latter being when fluid from the relevant formation is allowed to flow into and up the well), and the subsequent calculation of various well parameters. To collect the necessary data there is lowered into the well and onto the packer a test string —a length of tubing containing the tools required for testing. The flow of fluid from the formation of interest into the test string and thus to the test tools is controlled by a valve known as a sub-surface control valve.

The operation of the various tools included in the downhole test string can be effected using one of three main types of mechanism. These types are those actuated by reciprocal motion of the pipe string (the inner tube, of which the test string constitutes a part), by rotational motion of the pipe string, or by changes in the pressure differential between the tubing and the annular space which surrounds it in the well—hereinafter referred to simply as "the annulus". Test strings wherein the tools thereof are actuated by changes in annulus pressure are at present much in vogue, and it is this type of actuation mechanism that is to be employed with the apparatus of the invention.

A mechanism of the annulus pressure-responsive type requires the provision and maintenance of a fixed "reference" pressure within the tool. This, used in conjunction with an adjustable (and higher) annulus pressure, allows the establishment of the chosen pressure differential necessary to control the operation of the appropriate component of the test string. The achievement of such a fixed reference pressure is the subject of our co-pending British Patent Application No. 89/07,098.1 (Publication No: 2,229,748; P1049).

Following completion of the well testing procedure, it is necessary safely to "shut down" the test tools, and then to remove the test string from the packer assembly and pull it to the surface. These operations do, however, require careful control and planning. In the case of pressure-differential-actuated test tools, for example, the string will, at the end of testing, still contain the high pressure reference gas which has been used in creating the required differentials. It is extremely desirable for this gas in some way to be vented before the string reaches the well head, so that there are no potentially dangerous pressures trapped within the tools when the test string is received at the surface.

Additionally, it is an advantage if there be incorporated within the test string some means of isolating the upper portion of the tubing thereof, and of subsequently providing a route for communication between this tubing and the annulus, so that tubing-contained well liquid above the test string can then be circulated out of the tubing before it is raised to the surface. The isolation is conveniently accomplished using a ball valve suitably placed near the top of the test string, and such a ball valve particularly suitable for effecting this isolation is described in our co-pending British Patent Application No. 89/09,903.0 (Publication No: 2,231,069; P1062). However, reliance upon a single valve is not advisable, and consequently there is a strong case in favour of the utilisation of a second valve in the test apparatus. This latter valve can then be used either in addition to the main valve or, in the event of the latter not operating correctly, as an alternative thereto.

In the Specification of our co-pending British Patent Application No: 90/06,586.3 (Publication No: 2,230,802; P1069) there is described apparatus for these venting and isolation procedures that should facilitate the procedure for discontinuation of an oil well testing programme. Moreover, the apparatus permits those operations to be carried out as an automatic sequence, following the application of a single actuating pressure pulse to the annulus. For the venting of the reference gas, the invention suggests pressure release apparatus having two spaced pistons located at opposite ends of a chamber filled with that gas and blocking both a gas vent to annulus and a hydraulic liquid passageway (to further up the test string), the pistons being held together by a shear pin until the application of a predetermined pressure (higher than the gas reference pressure) at the outside ends of those pistons causes the pin to shear, allowing sequential movement of the two pistons towards each other, with the effect of firstly opening the gas vent to annulus, and secondly opening the passageway to a chamber of hydraulic liquid.

The hydraulic liquid pressure within this passageway then causes actuation of ball valve apparatus for isolating the upper section of tubing. This apparatus is in the form of a ball-valve-driving piston blocking another passageway for hydraulic liquid, which piston is forced to move under the influence of the pressure, breaking a restraining shear pin as it does so, and closing the ball valve while opening this other hydraulic liquid passageway, permitting transfer of hydraulic pressure to apparatus for venting the contents of the tubing to annulus. Finally, this venting apparatus contains a circulating valve—a valve (in this case a longitudinally-movable sleeve member) the position of which determines whether or not flow is permitted, via a vent port, between the test string tubing and the annulus.

This apparatus performs quite satisfactorily, but nevertheless might be said to have the disadvantage that it is a "one-off" system; once activated by the applied pressure causing the various shear pins to shear, the several operations resulting therefrom are irreversible, and the tool cannot be put back into the initial state. The present invention proposes a solution to this problem, by providing a novel valve arrangement that enables the opening and closing of the test string circulation valve, and—when that valve is closed—the opening and closing of the tubing isolating valve, as many times as desired, a complete cycle of operations—the closing of the isolation valve and the subsequent operation of the circulation valve—also being repeatable at will. To attain this end the invention employs a number of arrangements and systems some of which are inventive in their own right.

Firstly, it proposes the use of a J-slot indexer to control the operation of a tool, the slot being in the form of a closed loop track (so that after carrying out the complete cycle the tool returns to its initial state, and can be operated anew all over again), and there is a second closed loop track part of which is in common with the first track, which second loop can be gone round any number of times quite independently of, and alternatively to, going round the first track, the two tracks controlling two different (and independently controllable) tool mode operations.

Secondly, it proposes the idea of operating a tool having a plurality of modes by one or more of a succession of annulus pressure pulses (a pulse may be thought of as a pressure increment/decrement pair, usually applied in that order), wherein an initial operation is effected by one of the constituent pressure changes of a first pulse—the incremental one, say and the operation following the subsequent pressure change, or a part thereof—the decrement—is effected slowly—for instance, by constraining fluid flow through a restriction (in parallel with a one-way valve) —and if one or more second pulse (incremental change) each occurs within a given time (of the preceding pulses) the mode of the tool is altered, so that a third pulse thereafter causes a different operation to be initiated.

Thirdly, it proposes the use of two separate J-slot indexers, each in the form of a closed loop track, to control tool operation, one J-slot indexer controlling the movement of a first operating member connected to and driving a second operating member the movement of which is controlled by the other J-slot indexer.

Fourthly, it proposes the linking of two operating members, one driving the other, via a dog-tooth clutch mechanism in which the mating teeth are spaced so as deliberately to allow limited movement of one (the driving) member without any concomitant movement of the other (the driven) member.

The invention also proposes the idea of operating a tool by annulus pressure pulses, each consisting of an incremental and a decremental pressure change (though not necessarily in that order), in such a way that the actual operation (of a valve, say) is effected by one of these changes—for instance, the positive-going, incremental part of a pulse—the subsequent opposite change —thus, the decremental part of the pulse—having no comparable effect on the tool.

By a combination of various of these individual arrangements and systems there is provided the desired novel and inventive valve arrangement, wherein a tubing isolating valve can in response to annulus pressure pulses be cycled open and closed indefinitely while a circulation valve remains closed, and then, at any time chosen by the operator, the isolating valve can be closed and the mode of the tool changed so that the circulation valve opens and closes in response to annulus pressure pulses, whereafter following a "final" closing of the circulation valve the tool mode can again be changed so that the isolation valve once again responds to annulus pressure pulses . . . and the whole cycle can begin anew, and be gone through as many times as required.

In a first aspect, therefore, the invention provides a J-slot indexer useful to control the operation of a device such as a valve in a drill stem test tool, which indexer is of the type wherein there are two members movable one relative to the other, and one of the members carries a track and the other carries a track-following part, such as a projecting pin, that interacts with and is constrained to follow the track, so as to guide and control the relative movement of the two members in a pattern in accordance with the shape of the track, and thereby to control the operation of the device, in which indexer there are effectively two tracks, in the form of at least two different closed loops one of which controls the operation of a first device while the other of which controls the operation of a second device, and wherein the two loops are so disposed that one is adjacent thereto and outside but having a common section with the other, movement of the pin around one loop operating the first but not the second device, and around the other loop operating the second but not the first device, and there is means enabling the pin, when it is in the common section, to be caused thereafter to follow one or other of the loops, and thus cause the relative movement of the two members to take one or other of the corresponding two patterns, and so to control one or other of the two devices.

The invention relates primarily to the operation and control of drill stem test tools, and particularly such tools operated by annulus pressure changes, as commonly employed in the testing of hydrocarbon (oil) wells, and for the most part the following description reflects this, relating for convenience to such a use, even though the invention is not limited thereto.

J-slot indexers are nowadays well-known devices for controlling the various valves and other mechanisms in drill stem test tools, and so probably do not need any detailed explanation at this time, save perhaps to point out that they are conveniently employed to control the movement of one member—such as a pressure-driven/ piston-driven mandrel within the tubing of the tool—to open and close a "valve" either directly (as might be the case where the mandrel bears apertures therein that can be brought into and out of alignment with corresponding ports in the tubing, useful as a circulation valve) or indirectly (as might be the case where one mandrel physically drives another which in its turn either directly opens/closes ports or is linked to some other device . . . such as a ball valve controlling flow through the tubing). Examples of these are described hereinafter with reference to the accompanying Drawings. In either case, the indexer—and there may be two or more pin/track sets forming each indexer—will usually have one of the two members fixed relative to the tool—such a member could be the main tubing and the other movable relative thereto—typically, a mandrel, or internal tube, sliding longitudinally within the main tubing. Whether the track is on (or in) the fixed member and the track-following pin is on the movable member or vice versa is usually a matter of choice, though from a mechanical assembly point of view it may be preferable to choose one rather than the other. In the embodiments described hereinafter with reference to the Drawings the track is on a moving mandrel whilst the pin is on the tool's (fixed) main tubing, and there are in fact two sets of each, spaced either side of the tool, to balance the loads involved.

For the most part the track-following part on one of the members is described herein as a pin (or lug) projecting out from its support and into engagement with the track on the other member. Of course, the "pin" may take any comparable physical form, one such being a ball rolling in a bearing—this arrangement may reduce the frictional forces acting to prevent the two members' relative movement—but in general a fixed pin is quite satisfactory, and hereafter the term "pin" is used to represent the engaging track-follower regardless of its actual form.

The pattern of the, or each, track may be any required to control the relevant tool operation, and in this respect each track may be like any of the tracks presently used or suggested for use in the Art, save that it must have a final portion that connects the "end" of the track back to its "beginning", and so closes the loop. Closed-loop tracks are not in themselves new, although to date none have been described having the double-loop format of those of the present invention.

The main inventive feature of the J-slot indexer of the invention is the use of multiple track loops with a common section from which any one of the relevant track loops may be chosen at will. The idea behind this is that each track loop defines one (predetermined) tool mode, or set of tool operations—opening and closing a main tubing valve, say, or opening and closing a circulation valve—that can be carried out either quite independently of any other operations set or after some such other operations set has been effected to place the tool in a chosen state. For example, in one embodiment described hereinafter with reference to the Drawings there is shown a two-track system in which one track controls the state of the main tubing ball valve when the circulation valve is shut (and the loop can be traversed as many times as required without in any way affecting the circulation valve) while the second track controls the state of the circulation valve when the main valve is closed (and this loop can be traversed as many times as required without affecting the main valve).

Each track loop has a common section with another, and for any pair of loops the two are adjacent (like a figure-of-eight).

Each track loop bears a section in common with another, and while the common section of track may in principle fall anywhere along the tracks involved, and thus anywhere within the sequence of operations they define, in practice the common section naturally needs to be positioned so that the state of the tool the result of one set of operations is compatible with the state(s) to be gone through when changing to the other set. For example, when having tracks controlling the operation of both a main tubing valve and a circulation valve it is highly desirable to leave the main valve track, and enter the circulation valve track, only when the main valve is shut—and then to return to the main valve track only when the circulation valve is shut.

As is discussed further below, it may be desirable specially to shape the common section, or the junctions of the start and end parts thereof, so that the pins can be guided into one or other depending on when a driving force is applied.

The relative movement of the two members (the pin-carrying one and the closed-loop-track-carrying one) may be driven in any suitable way, but, in an annulus-pressure-operated tool, will normally be driven by applied pressure pulses acting upon a piston attached to or part of one of the members. These pressure pulses will normally be positive pulses, having first an incremental part and then a decremental part, and it is usually convenient if the incremental part be the driving part, the subsequent reduction in pressure (the decremental part) having no operative effect (though it may allow a spring to return some part of the tool to a previous position or state).

In accordance with the invention the pin may be caused to follow one track loop or another in response to some action effected while the pin is in the common section. There are a number of ways in which the track selection might be achieved, including the use of "points" ("switches") as employed in connection with railway tracks, but that one preferred, which involves no extra moving parts, is the shaping of the section, and/or of its start and end junctions, such that driving forces applied at different times—when the pin is on a different part of the section—will cause different things to happen, and different parts of the track loops to be traversed as a result. Thus, as shown in the Drawings, if one portion of the track is defined as two parts roughly parallel to the direction of the members' relative movement, one of which parts has a slanting sector by which it is joined to the other, then, if the pin sits at rest where the one part and its slanting (non-movement-direction-parallel) sector joins the other part, and if a driving pulse will cause the pin in effect to move away from its rest position, then when it is already away from that rest position it will move along whichever part it is in, but when it is actually at that rest position it will only move up the non-slanted part. Again, and also as shown in the Drawings, if one or other junction (of the two track loops) is angled to left or right of a "straight" part aligned with the direction of relative movement of the two members, then a driven movement of the pin along the track towards and through this junction will always be along the "straight" part rather than along the angled part to left or right. In the particular case of this shown in the Drawings each angled part is the relevant track loop, and towards the middle of one loop common section there is a pin rest point as just described above, Thus, the junction into the track section is so shaped that a further driving pressure pulse while the pin is past but still adjacent that junction (and before it has reached the rest point) will drive the pin back to the side junction and on along the straight part into the second loop rather than back round the first loop.

It will be evident that the timing of the various driving pressure pulses is crucial in determining which track loop is to be followed (and thus which set of tool operations is to occur); it is clearly difficult for an operator on the surface to ensure that the next pulse in a set of pulses is applied at just the right point in time to catch at the right position the pin in a tool within a test string that is possibly several miles down a borehole beneath the operator's feet. This problem is solved by the relatively simple expedient of causing the motion of the pin when in a relevant (critical) part of the section to be very much slower—to take considerably longer—than its movement in other parts of the track. This, which forms a main feature of a second aspect of the invention, can itself be achieved in a number of ways. One involves the movement of one or other member relative to the other in one direction being constrained over at least part of its range by it having to drive fluid through a constriction. This is described further hereinafter.

As just noted, this idea of slowing the movement in one direction of one member relative to the other (conveniently by making that movement drive a fluid through a constriction) is the central feature of a second aspect of the invention. In this aspect, then, the invention provides, for a tool having a plurality of modes, a method of operating the tool by one or more of a succession of pressure pulses, each pulse causing relative movement between one tool member and another first in one and then in the opposite direction, wherein an initial operation, in an initial mode, is effected by one of the constituent pressure changes of a first pulse causing relative member movement in one direction, and thereafter the subsequent opposite relative member movement, or a part thereof, is effected relatively slowly, and if—and only if—one or more second pulse occurs within a given time (of the preceding pulse) the concomitant relative member movement causes the mode of the tool to be altered, so that a third pulse thereafter causes a second operation, in the second mode, to be initiated.

The method the subject of this second aspect is one suited to a tool with a plurality of different operating modes—as typified by a tool like that described hereinbefore which can act either to control tubing flow of formation fluid (the initial operation) involving a main tubing valve, or to control circulation between tubing and annulus (the second operation), involving a circulation valve.

This method is one in which relative movement between one tool member, or part, and another causes there to be taken some mechanical action, such as the opening of a valve, and in which this relative movement is reversible, such that after movement—relatively rapid movement—in one direction the two members undergo relative movement in the opposite direction. This return movement is relatively slow, at least over a part thereof, so as to take a relatively long time, and it is this "lengthened" return period that eases the selection of a moment—before or during this period—when a further pulse-driven relative member movement initiates a second operation rather than merely repeating the first (as it would were it applied after the return period). Of several mechanisms by which this differential movement rate—slower in one direction than the other—can be achieved, a preferred one is that in which fluid is driven (by the relative movement) back and forth through two passageways in parallel, one being a restricted passageway (through which the fluid's finite viscosity means it necessarily travels with difficulty) and the second passageway (for the fluid) being fitted with a one-way valve. In the direction in which the valve opens, both passageways allow the fluid to pass therealong, and so the overall rate of flow (and the movement of whatever piston device is driving the fluid) is "relatively" fast, but in the opposite direction—that in which the valve closes—only the restricted passageway allows fluid to pass, and so the flow (and the associated movement) is necessarily constrained, and thus relatively slow.

The delay induced depends upon the degree of the restriction, and rather than this restriction being a mere narrowing of the passageway it is very preferably one oil those special flow-control valves known as Jeba Jets and available from Lee Products Ltd. These valves are largely viscosity-independent, so no matter what the temperature is, and what is the viscosity of the working fluid (usually a silicone oil), the delay induced by the restriction will remain constant.

It is further preferred that the return relative movement be in at least two parts—a first one in which the movement is slow, followed by a second one in which it is not so slow—and in fact that it be in three parts—a slow movement both followed and preceded by not so slow movement. This can conveniently be achieved by arranging for there to be a third parallel passageway (for the fluid) which opens and closes in response to the relative movement of the pin and track members. More specifically, if this third passageway is first open, but is then closed after a first amount of relative movement, and finally re-opens after a second amount of relative movement, then in the return direction the relative movement will be, as required, first faster, then slower, and finally faster. In a particular embodiment of this arrangement one member is a tubular mandrel (carrying the track) moving within a fixed tubular other member (carrying the pin), and the two define a pair of annular chambers joined/separated by the restricted passageway, by the one-way valve passageway and by a relatively constricted annular portion, and the mandrel carries a fixed "piston" (ring) that moves with the mandrel from the chamber on one side of the constricted portion, into and through that portion, within which it is a sealing fit, and thence into the chamber on the other side. When the piston (ring) is within the constriction it blocks off the annular passageway between the two chambers, so that the fluid flowing therebetween can only pass via the one-way valve and the restricted passageway; when the piston (ring) is not within the constricted portion then the fluid can flow therethrough as well. In this way, on the return stroke the fluid can flow first quickly, then only slowly (as the constricted portion is blocked by the piston), and finally quickly again.

The method of the invention is such that the multi-mode tool is operated by a succession of pressure pulses, a first initiating a first operation in a first mode, a second (or several "seconds") within a given, short, time of the first (or each preceding) changing modes, and a third then initiating a second operation, in the second mode. The arrangement can be one in which a single second pulse within the given time of the first pulse causes mode change, or it can be one in which there must be a series of two or more second pulses—say, four—each within a given short time of the preceding pulse, to effect the mode change, a failure to provide any one of these second pulses in time sending the tool right back to the beginning of the series (so that if, for instance, the fourth pulse of the necessary four is late, then all four pulses must be applied all over again). An example of each variety is described hereinafter with reference to the Drawings.

The invention in its first aspect involves the use of a J-slot slot indexer to control the operation of various valves or other components of the test tool. On occasion, however, the number of items to be controlled, and the actions they perform, may make it difficult to deal with them all using only a single J-slot indexer. For example, one valve may be operated by the longitudinal (along-tube) movement of a body, while another may, possibly dependently, require the rotational (around the tube's axis) movement of another body. For this reason the invention provides, as its third aspect, a drill stem test tool having at least two operating members to be controlled one in at least partial dependence upon the condition of the other, wherein there are two separate but operatively linked J-slot indexers, each in the form of a closed loop track, to control overall tool operation, one J-slot indexer controlling the movement of a first operating member connected to and driving a second operating member the movement of which is controlled by the other J-slot indexer, at least one of the J-slot indexers being a two-loop indexer of the invention.

Such an arrangement is of particular value in the control of the operation of a multimode tool like that of the invention having both a main tubing valve and a circulation valve, the operating members being the mechanical devices or links driving the two valves, and the operation of the circulation valve needing to be effectively dependent upon the condition of the main tubing valve (so that the former can only be open when the latter is closed) and yet being independently controllable in that either valve can be opened and closed at will without disturbing the state of the other.

Although in principle it may be that the movements of the two operating members can be of the same kind—thus, both longitudinal, or both rotational—in the preferred case of the present invention they are of different kinds, for that makes much easier the matter of causing one to move, and so effect the relevant operation, without the other also moving in an operative way. Thus, in the case of the main tubing valve and circulation valve combination, it is preferred if the one—conveniently the main tubing valve—be worked by a rotational movement of its operating member, while the other—the circulation valve—be worked by a longitudinal movement of its operating member. Indeed, this is what is shown in the Drawings discussed further hereinafter, where the main tubing valve is (as noted) a ball valve, operable—albeit indirectly—by a rotating member, while the other is a sliding sleeve valve wherein a tube-internal apertured sleeve slides longitudinally to bring its apertures into registration with corresponding ports in the casing leading to annulus, so enabling a path from the inside of the tube out into the borehole.

Most desirably one of the J-slot indexers is an indexer of the invention, having at least two closed loop sections therein. In the main valve/circulating valve combination already described it is preferred that the J-slot indexer controlling the circulation valve be the indexer of the invention, the main valve indexer being simply a single track closed loop (although, for a quite different reason, in the embodiment described with reference to the Drawings the main valve indexer is also a two-track device).

In the case of the preferred main valve/circulation valve combination described herein there is a need for the J-slot indexer controlling the main tubing valve (by rotation) to rotate that valve's operating member back and forth, as the circulation valve J-slot indexer drives its operating member up and down, without actually operating the main valve. This apparent contradiction can be solved, so that at least some limited rotational movement of the main valve operating member is permitted without causing the valve to operate, by coupling the drive from the operating member to the valve via a "slack" device—that is, a device wherein the drive in any one direction only positively couples through to the driven member once some slack has been taken up (whereupon there is now slack in the opposite direction, which slack must similarly be taken up before the drive is coupled through in that opposite direction). In its fourth aspect, then, the invention provides such a "slack"-utilising drive coupling mechanism between a driving and a driven operating member, wherein the linking of the two operating members, one driving the other, is via a dog-tooth clutch mechanism in which the mating teeth are so sized and spaced as deliberately to allow limited movement of one (the driving) member without any concomitant movement of the other (the driven) member.

As noted, this slack drive arrangement is especially useful in a drill stem test tool main valve/ circulating valve combination for indirectly connecting the circulating valve operating member drivingly to the main valve operating member (as indeed is shown in the accompanying Drawings). In such a utilisation it is convenient if the dog tooth arrangement be such that each tooth is an arc subtending 45°, and that on each side of the clutch there are two diametrically-opposed teeth (thus, with 90°-subtending gaps therebetween), so that when "fitted" together the arcuate distance any tooth on one side can move between the other side's teeth is only 90°. In this way the clutch driving member can rotate a whole 90° between left and right engagement without moving the driven member at all—and it is this freedom to move that enables the circulating valve operating member to move to operate the circulating valve but without necessarily causing operation of the main valve, despite the fact that the circulating valve's operating member is physically linked to the main valve's operating member, for the latter, as the "driving" member, is coupled with slack to the "driven" member taking the drive on to the main valve.

In the embodiment shown in the Drawings the driving side of the dog-tooth clutch arrangement is the rotatable but longitudinally-fixed indexing sleeve of the main valve indexer (which is itself driven by longitudinal movement of the mandrel extending from and controlled by the circulating valve indexer, and carries the apertures alignable with the ports of the circulation valve), while the driven side is merely an intermediate member carrying the drive through to the main valve's ball cage (which itself actually drives the ball). In this way longitudinal movement of the mandrel is converted to rotary movement of the main valve indexer sleeve, which is carried through to the intermediate member who's rotary movement is then converted back to longitudinal movement of the valve cage . . . which rotates the ball open or shut, as appropriate, but only after any slack in the dog-tooth clutch has first allowed some limited sleeve rotation without any intermediate member rotation.

The use until now of annulus pressure pulses to operate the various tools in, for example, a drill stem test tool string has been arranged in such a way that a change of pressure in one direction—an increment, say —has caused some action to occur while an immediately-following change of pressure in the opposite direction—a decrement—has caused some other action (typically, a reversal of the first action). For example, a pressure increment might cause a ball valve to open, and the subsequent pressure decrement when the increment is removed might cause it to shut. There are problems with this, not least of which it is not always easy, or convenient, to maintain the intermediate pressure for the possibly lengthy time required to carry out some other action (as, for instance, might be the case when circulating out all the fluid within the pipe), and the invention enables tool operation to be effected in a novel and advantageous manner, in which the tool is worked by complete annulus pressure pulses, each consisting of an incremental and a decremental pressure change. In yet another aspect, therefore, the invention provides a method of operating a drill stem test tool incorporating a main tubing valve and a circulation valve each opened and closed by the relative movement of a driving member operatively linked thereto, the method being such that either valve can be opened and closed as many times as required without affecting the other, in which method a two-track J-slot indexer as defined in any of the preceding claims is employed to control the operation of the two valves, and one track guides and controls the driving member to operate the main tubing valve while the circulation valve is closed and the other track guides and controls the driving member to operate the circulation valve while the main valve is closed.

Each annulus pressure pulses consists of an incremental and a decremental pressure change, though not necessarily in that order (although most conveniently they are so), in such a way that the actual operation being carried out (the operation of a valve, say) is effected by one of these changes—typically the positive-going, incremental part of a pulse—while the subsequent opposite change —thus, the decremental part of the pulse—has no comparable effect on the tool. It will often be the case that the operation being carried out is itself a two-part one, as in the opening and subsequent closing of a valve, and it can easily be seen that the method of the invention then involves two pressure pulses, one of which causes one part of the operation (opens the valve, say) while the other of which causes the other (closes that valve).

The several aspects of the invention as described herein are not only of value in themselves, they specifically provide a complete systems for the working of a tubing isolating (main) valve and a circulation valve associated therewith. By a combination of various of the individual arrangements and systems there is provided the desired novel and inventive annulus-pulse-driven valve arrangement, wherein the tubing isolating valve can be cycled open and closed indefinitely while the circulation valve remains closed, and then, at any time chosen by the operator, the isolating valve can be closed and the mode of the tool changed so that the circulation valve opens and closes instead, whereafter, and following a "final" closing of the circulation valve, the tool mode can again be changed so that the isolation valve responds once again . . . and the whole cycle can begin anew, and be repeated as many times as required.

In more general terms, the apparatus of the invention relates primarily to a dual valve mechanism to be located downhole during the testing of hydrocarbon wells, and which can be used for a multiplicity of purposes. This apparatus, which offers a flexible and rapid mode of operation, can be used to control the flow of hydrocarbon fluids from a subterranean well to the surface as well as the flow of stimulation fluids (e.g., acids) from the surface to the subsurface formation. The apparatus can also be used to test the integrity of the downhole pipework (such as the tubing and casing strings). An important feature of this apparatus is the ability to act as an annulus overpressure safety valve providing a fail safe mode of operation when the annular pressure exceeds a predetermined level either by choice or because of a potential dangerous downhole problem such as a leak of high pressure fluid from the tubing to the annulus.

The apparatus of the invention, primarily a resettable safety circulating valve, is operated and controlled by the action of a unique and novel dual indexing system incorporating a hydraulic delay mechanism which itself is activated by the application of differential pressures across a mandrel piston (these pressure differentials are conveniently created between the higher pressures applied to the annulus from surface and a constant "reference" pressure present within the body of the tool). The two valves, a ball valve and a circulating valve, can be operated when required. The selection of which is to be operated is controlled by the action of the dual indexing systems and the hydraulic delay. The ball valve is used to control the flow of fluid through the bore of the tool, from surface to the downhole formation, and can be operated as many times as is necessary without activating the second valve. This second valve, a circulating valve, is used to provide communication between the annulus and tubing bore (which allows displacement of fluids in the tubing bore above the ball valve and in the annulus). The fail safe mechanism when activated automatically closes the ball valve, to isolate the hydrocarbon bearing formation from the surface, and opens the circulating valve to allow fluid displacement above the closed ball valve.

This fail safe mechanism—and more particularly the manner in which fail safe operation is here achieved (essentially by the attachment of the J-slot tracked index sleeve onto the moving mandrel by shear pins)—is itself inventive. Accordingly, in yet another aspect this invention provides a fail safe mechanism for a valve system of the type employing a J-slot indexer system to control the movement of a valve-operating mandrel urged into longitudinal movement by the forces applied thereto, wherein the J-slot track is formed on a sleeve fixed to its support against longitudinal movement therealong by shear pins, whereby if in operation the forces applied to the mandrel cause the shear pins to shear, freeing the mandrel from the longitudinal movement constraints imposed thereon by the indexer sleeve interacting with its indexer pin, the mandrel will move, under the continuing influence of the applied forces, to that position which results in the valve being placed in its fail safe state.

As explained in more detail in connection with the embodiments discussed hereinafter with reference to the accompanying Drawings, in the double indexer system preferred in this invention, in which the J-slot indexer sleeve is carried by (and thus shear-pin affixed to) the mandrel itself, facing outwardly therefrom, the relevant track-following pin being mounted on and facing inwardly of the tubing, the fail safe operation of the mandrel drives it further than it would normally travel under indexer control, the final state being one in which the main ball valve is shut, having been so driven regardless of its previous state, while the circulating valve is open, also being made so regardless of its previous state. This is the fail safe state of the system—with the well closed off, and with the inside of the tubing string communicating with annulus.

An embodiment of the invention is now described, though by way of illustration only, with reference to the accompanying Drawings in which.

Figure 1:
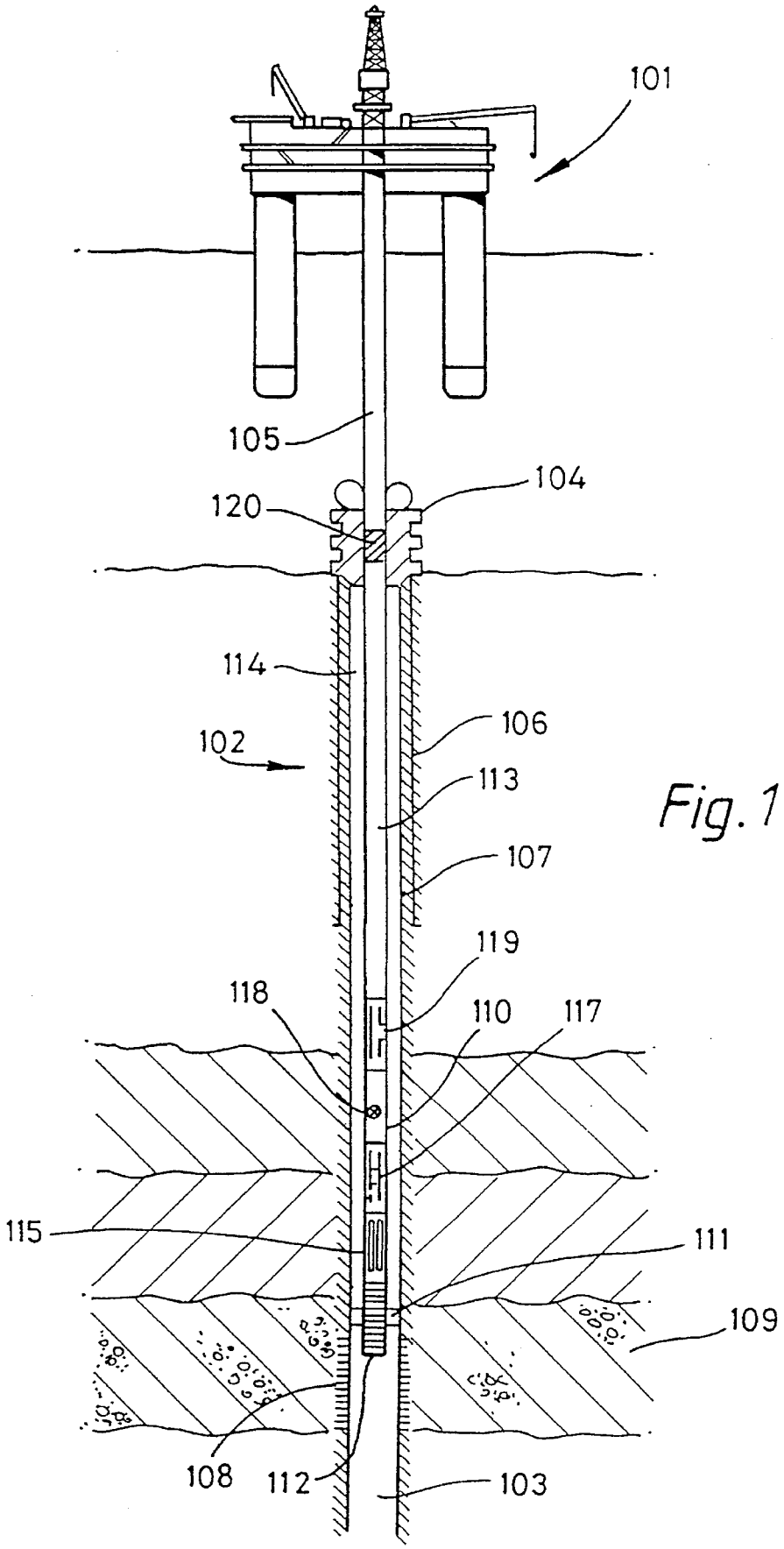
FIG. 1 is a simplified cross-sectional view of an offshore oil well with a test string including safety circulation valve apparatus of the invention.

FIG. 1 depicts a floating drilling rig (101, not shown in detail) from which has been drilled an oil well (generally 102) having a well bore (103) reaching down to a rock stratum constituting the formation (109) of interest. Located at the top of the well bore 103 is a blow-out preventer mechanism (BOP; 104, not shown in detail) which is connected to the rig 101 by a marine riser (105). Cemented into the well bore 103 are a shallow casing (106) and a deep casing (107); the lower end of the latter has a multitude of perforations (as 108) permitting communication between the well bore 103 and the oil formation 109.

Situated within the well bore 103 is a test string (110) comprising tubing (113) ending in a set of test tools (see below). The string 110 is set at its lower end into a packer (111), and a seal sleeve (112) seals the packer 111 to the test string 110, thus isolating the tubing 113 thereof from the annulus (114).

Above the seal sleeve 112 is a gauge carrier (115) which contains electronic or mechanical gauges (not shown) which collect downhole pressure and temperature data during the test sequence, Above the gauge carrier 115 are a constant pressure reference tool (117) and the sub-surface control valve (118). A circulating sleeve (119) permits removal of any formation fluid remaining within the test string 110 prior to its withdrawal from the well bore 103. At the top of the test string is a subsea test tree (120) which serves both as a primary safety valve and as a support for the rest of the test string 110.

The present invention concerns the valve apparatus within the circulating sleeve section 119.

During the drilling of the well, and prior to testing, the bore of the well is filled with drilling fluid which provides hydrostatic pressure at the formation depth (this is at a higher pressure than the formation fluid pressure, and hence prevents the formation fluids from entering the well bore and escaping to surface). When it is required to test the well the test string is lowered into the well bore from the drilling rig. The test string includes the circulation sleeve 119, and within that sleeve are a main tubing ball valve and a circulation sleeve valve (discussed in more detail hereinafter).

To enable production of the formation fluid it is necessary to reduce the hydrostatic pressure of the well fluid in the tubing to a level below that of the formation fluid pressure. This is achieved either by lowering the test string into the well bore with the circulation sleeve's ball valve in the closed position (so the pipe tubing is empty) or by using the operation of the sleeve's circulating valve to enable the displacement of the contents of the tubing string by a "lighter" fluid pumped in once the string has been set at the required depth (then, because this provides a hydrostatic pressure at formation depth which is lower than the formation fluid pressure, when the ball valve is opened the formation fluids can enter the well bore and flow to surface through the tubing string). The testing of the well in order to evaluate its production potential is therefore controlled by operation of the ball valve section of the resettable safety circulating valve. When the ball valve is open formation fluids will be able to flow to surface, while, conversely, when the ball valve is closed the well will be "shut-in" so preventing formation fluids being produced to surface.

Figure 2:
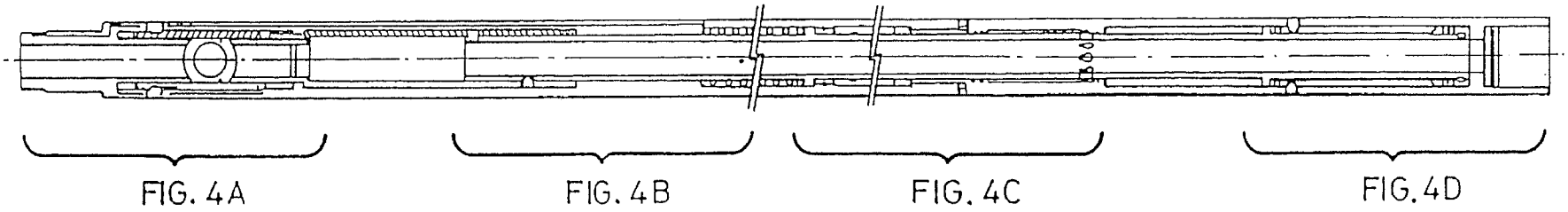
FIG. 2 shows a section through a safety circulation valve section included in a test string of the type used in the well of FIG. 1.
Figure 3B:
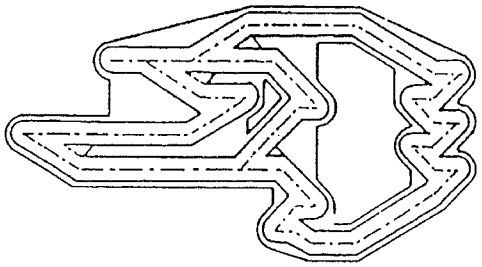
FIG. 3 (parts A and B) shows two closed loop J-slot indexer slots as proposed by the invention and used in the FIG. 2 safety circulation valve.
Figure 3A:
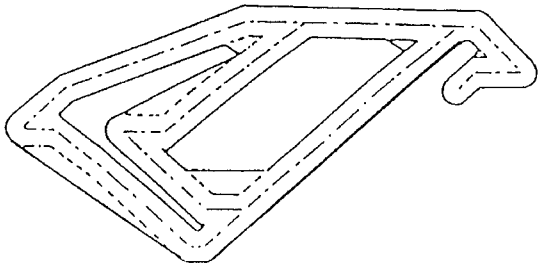

FIG. 2 shows a safety circulating valve tool section—a Resettable Safety Circulating Valve of the invention—included in a test string of the type used in the well of FIG. 1 (the tool has three main states, discussed in more detail with reference to FIG. 4). There are effectively two main parts to the tool: a ball valve section (FIG. 4A) the opening and closing of which provides a mechanism for controlling the flow of fluids from the hydrocarbon bearing formation to surface (and hence is the basic mechanism used for testing the reservoir), which is controlled by the movement of a first J-slot indexing system (FIG. 4A, B) in conjunction with a dog clutch arrangement (FIG. 4A); and a circulating valve section (FIGS. 4B, C, D) the opening and closing of which provides communication between the annulus and the tubing bore (this is controlled by the movement of a second J-slot indexing section (FIG. 4D) incorporating a hydraulic delay (FIG. 4B) and the mandrel piston (FIG. 4C). The operation of the tool is initiated by creation of differential pressure across the mandrel piston. A shear pin release mechanism linked to the mandrel indexer provides the fail safe operation when the annulus pressure exceeds a predetermined level.

Figure 4A:
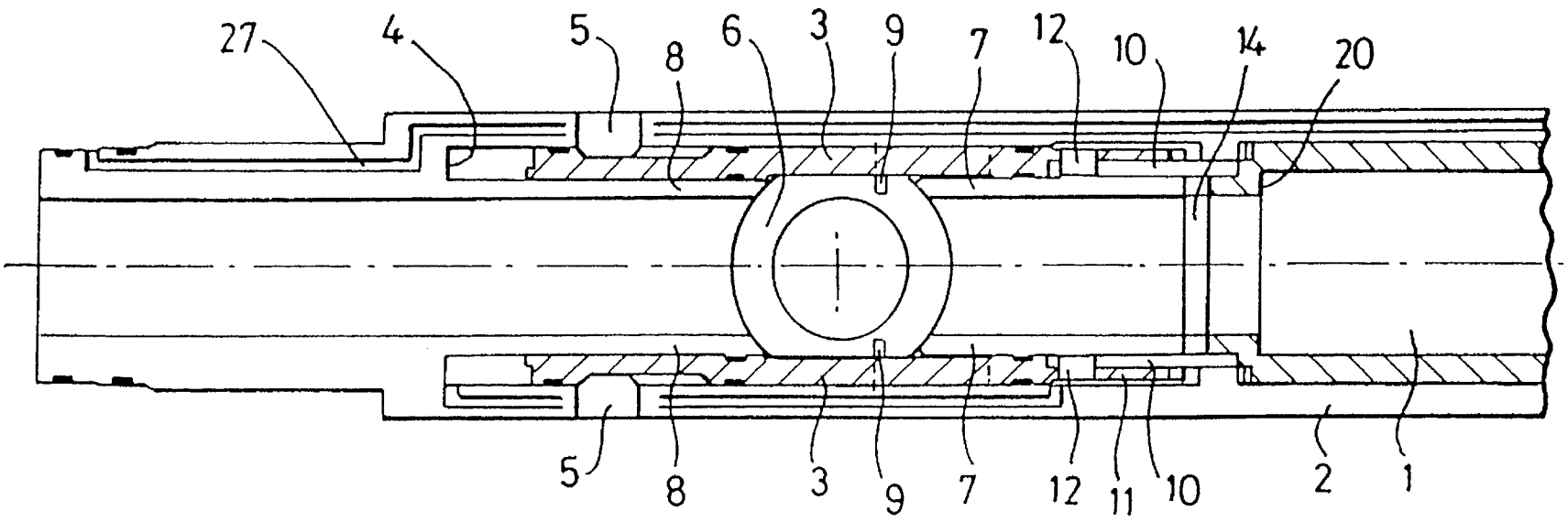
FIG. 4 (parts A to D) show in more detail and in cross section a safety circulation valve as shown in FIG. 2 (the right hand side of each individual Figure runs on to the left hand side of the subsequent one; the left sides are the low sides, while the right sides are the high ones)
Figures 1, 4B:
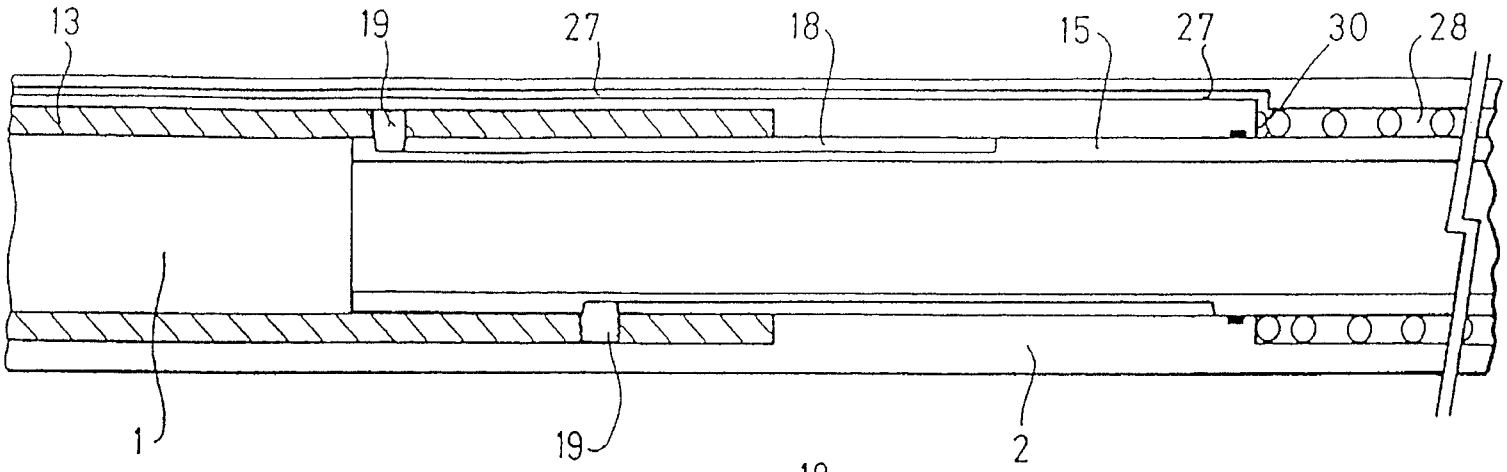
Figures 2, 4B:
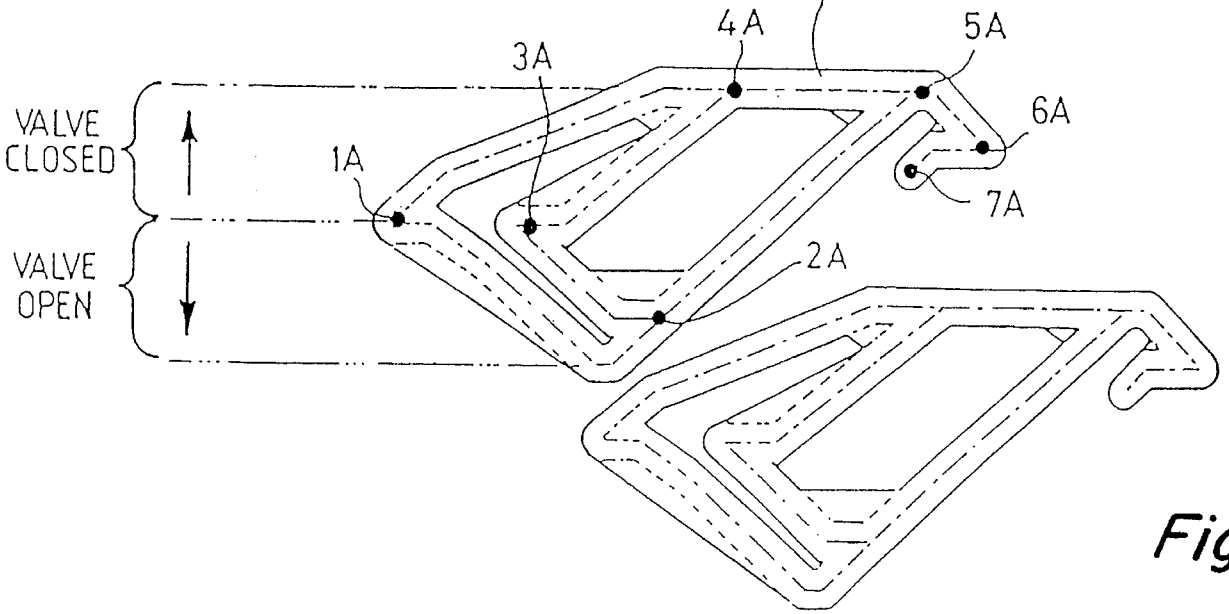
Figure 4C:
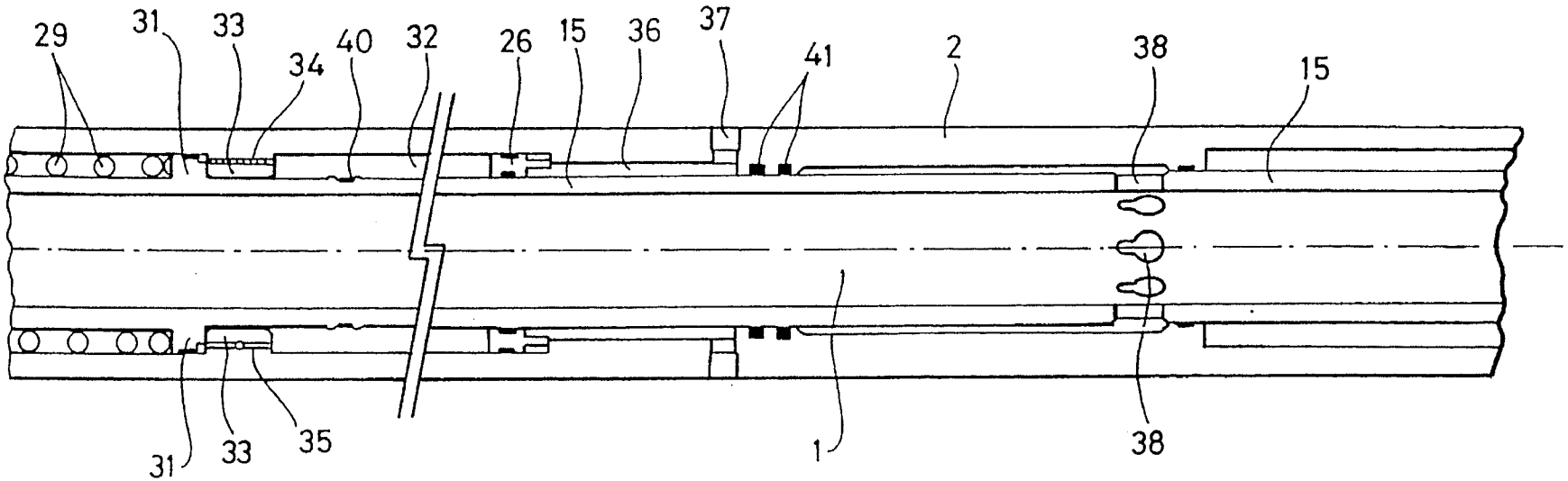
Figures 3, 4D:
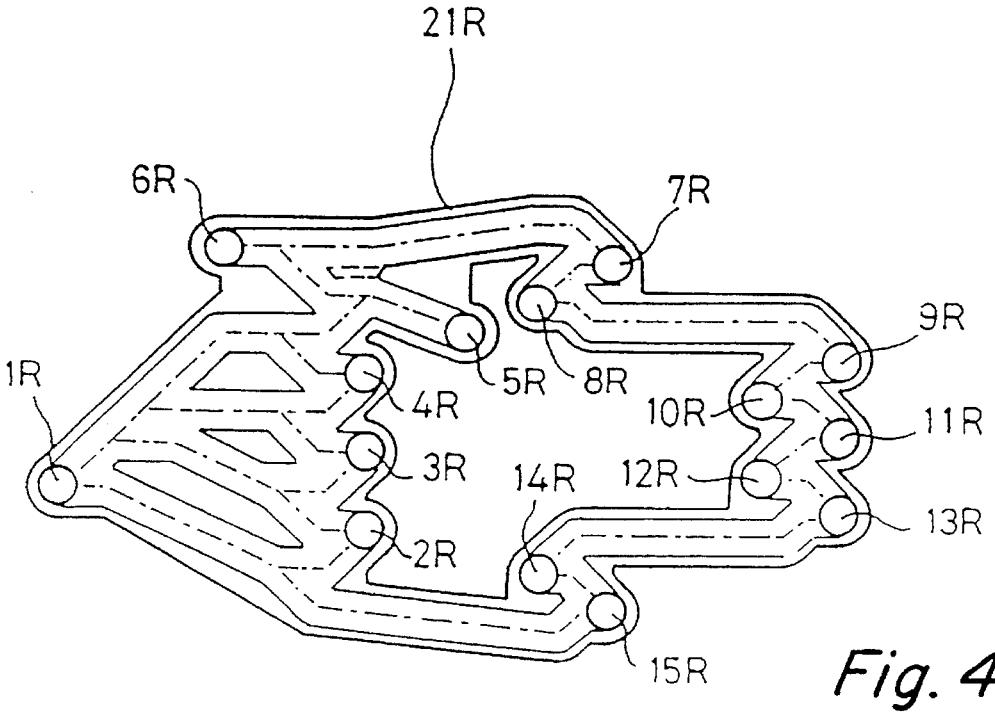
Figures 3, 4B:
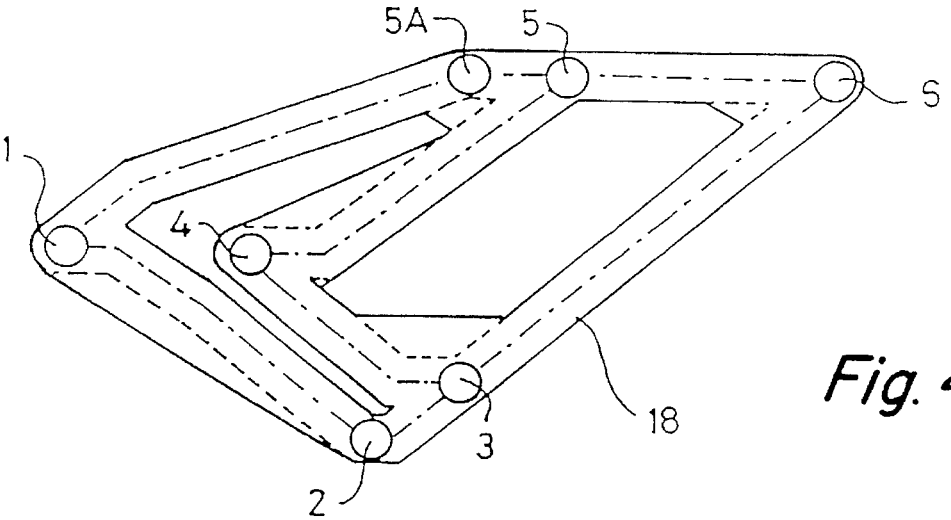
Figure 5:
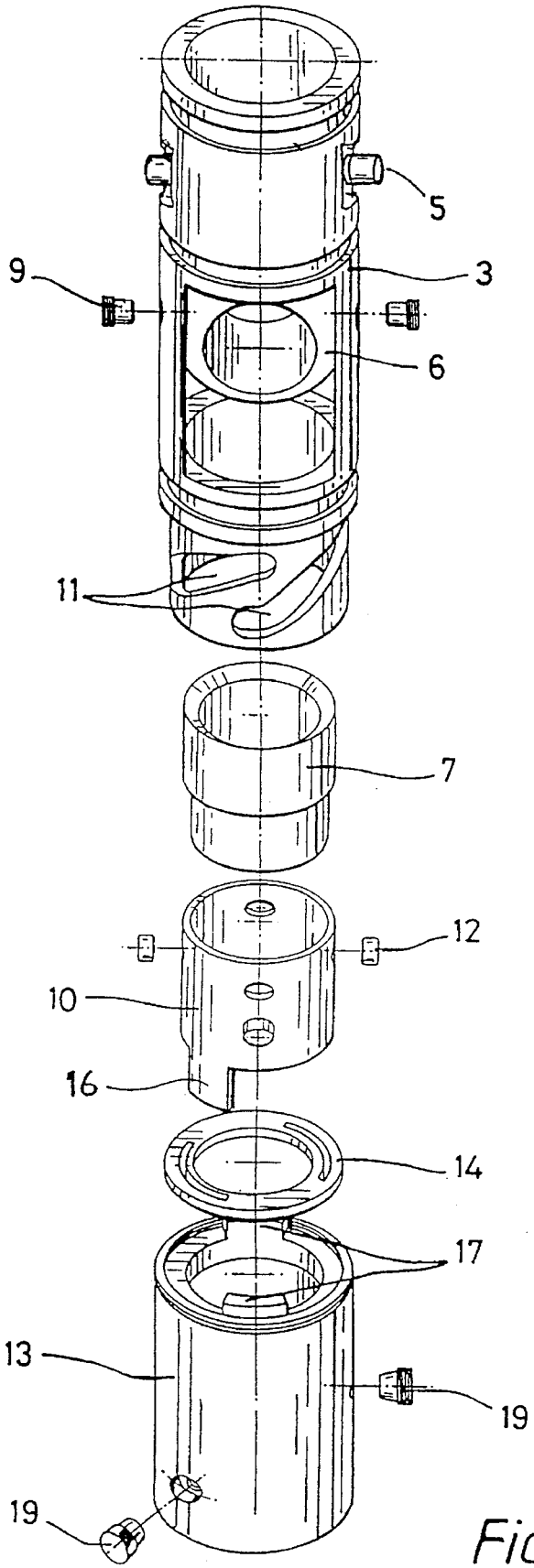
FIG. 5 shows in exploded perspective a main ball valve used in the safety circulation valve of FIG. 2.
Figure 6:
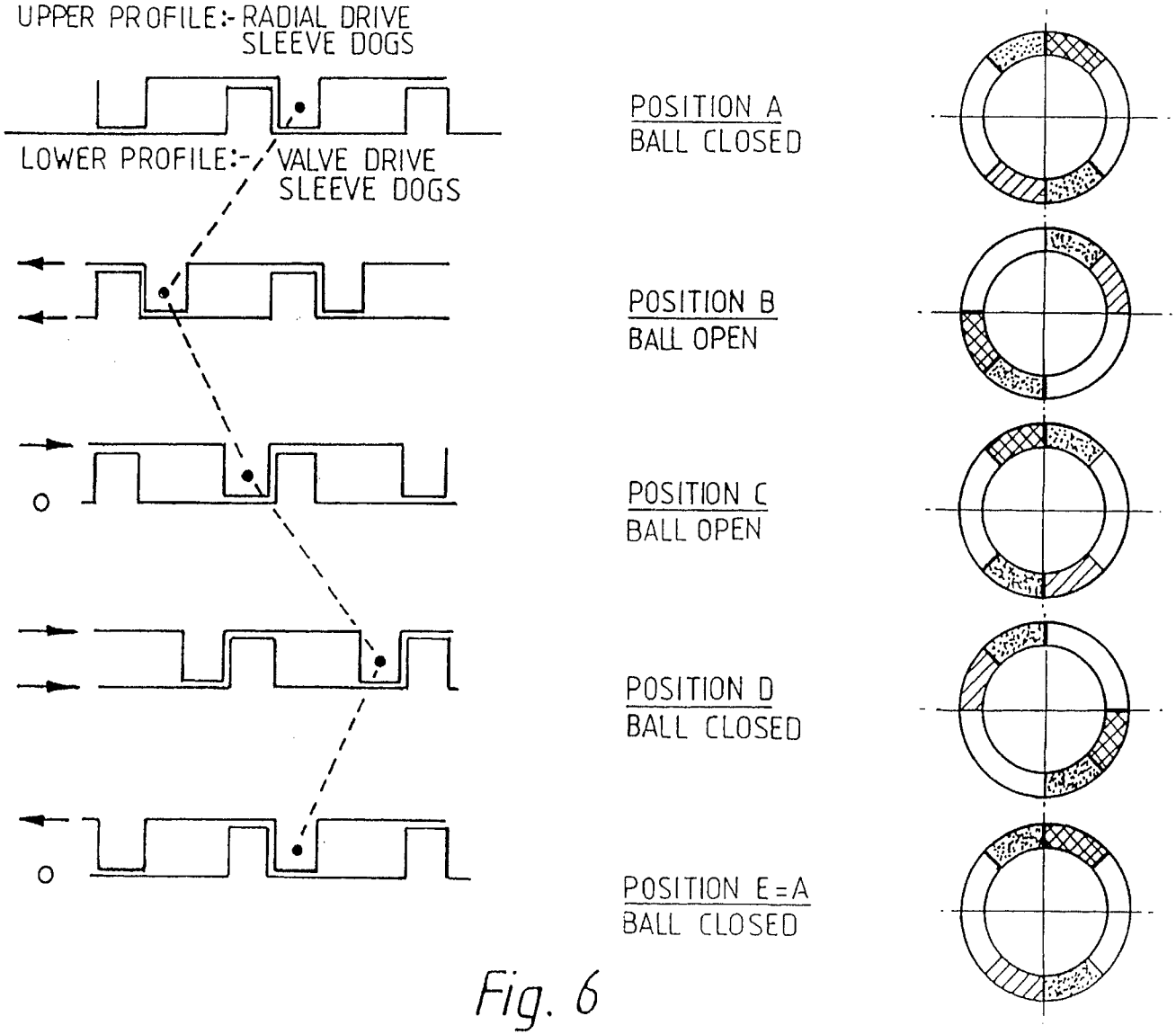
FIG. 6 (parts A to E) shows details of the slack-providing dog-tooth clutch system employed in the safety circulation valve of FIG. 2, being a sequence depicting the relative positions of the dog teeth during operation.

FIGS. 4A to D show in more detail the safety circulating valve tool (Resettable Safety Circulating Valve) as shown in FIG. 2 (the FIG. 3 two closed loop J-slot indexer slots are shown in FIGS. 4Bii and 4Dii, the main ball valve is shown in FIG. 5, and the slack-providing dog-tooth clutch system is shown in FIG. 6).

FIG. 4 shows the tubular form of the tool, which has an internal bore (1). The operation of the tool is performed by components contained within a main housing (2) between the internal bore 1 and the outer diameter of the tubing. In the FIG. 4 diagrams of the indexing sections the valve indexer loop (FIG. 4Bii) is shown featuring the relative positions on the loop—1A, 2A, 3A and so on—which correspond to controlled operations of the valves, while the mandrel indexer loop (FIG. 4Dii) is shown featuring the relative position on the loop—1B, 2B, 3B and so on—which correspond to the controlled longitudinal movement of the mandrel.

FIG. 4A shows the ball valve mechanism in its position in the lower end of the tool located in the main housing 2. FIG. 5 shows the ball valve mechanism in more detail. The mechanism comprises a valve cage (3) held in position between the main housing 2 and the internal bore 1 which has a limited longitudinal movement from its initial position shown in FIG. 4A to its final position against end stop (4) of the main housing 2. The valve cage 3 is restricted from rotational movement by cage lock (5). The ball (6) of the valve is held in position by fixed upper and lower ball seats (7, 8), and is connected to the cage 3 by ball pins (9). Movement of the cage 3 will via pins 9 rotate the ball 6 around the fixed position between the upper and lower ball seats 7, 8.

A valve drive sleeve (10) is attached to the valve drive slots (11) in the upper end of the valve cage 3 by valve pins (12). The drive sleeve 10 is restricted to rotational movement only in its position between the main housing 2 and the upper ball seat 7. Rotational movement of the sleeve will be translated to a longitudinal movement of the valve cage 3 via the movement of the valve pins 12, which in turn will control the opening and closing of ball valve 6. Rotational movement of the sleeve 10 is controlled by engagement with radial drive sleeve (13) via drive disc (14). Drive sleeve 13 is restricted to rotational movement only, being locked in a longitudinal position between the main housing 2 and the mandrel (15). The engagement between the valve drive sleeve 10 and the radial drive sleeve 13 is achieved between the valve drive sleeve dogs (16) and the radial drive sleeve dogs (17). When these dogs are engaged, clockwise or anti-clockwise rotation of the radial drive sleeve 13 will be transferred to the valve drive sleeve 10 which will in turn be translated to a longitudinal movement of the cage 3.

FIG. 6 shows the relative positions of the radial and valve drive sleeve dogs 17, 16. Each of the drive sleeves has two diametrically-opposed dogs each of a size equivalent to 45° of the full 360°. Therefore these dogs will not always engage, and so at certain times rotational movement of the radial drive sleeve 13 will no result in rotational of the valve drive sleeve 10. This free movement acts as a clutch mechanism, enabling required directional changes to take place during the indexing sequence.

FIG. 6 shows the sequence of positions between the radial and valve sleeve dogs 17, 16. Position A shows the initial start position, with both sets of dogs engaged and ball valve 6 closed. Position B shows the position after the radial drive sleeve 13 has rotated by 90° to the right. This movement will also have rotated the valve drive sleeve 10 90° to the right. This rotational movement will be translated to a longitudinal movement of the valve cage 3 via valve pins 12 engaged in valve drive slots 11. This 90° of rotational movement will be sufficient to move the valve cage 3 its full travel to end stop 4 and open ball valve 6 via ball pins 9.

Position C shows that the radial sleeve drive 13 has rotated 90° to the left. Since during this movement the drive dogs were not engaged there is no movement of the valve drive sleeve 10, and hence the ball 6 remains in the open position. At the end of this rotation the drive dogs become engaged. Position D shows that the radial drive sleeve 13 has rotated a further 90° to the left. Since the drive dogs are now engaged the valve drive sleeve 10 will also be rotated 90° to the left. This movement is now translated to a longitudinal movement of the valve cage 3 via valve pins 12 in slots 11, and the cage will be returned to its original position, and in so doing will close ball valve 6.

Position E shows that the radial drive sleeve 13 has now rotated 90° to the right. Since the drive dogs were not engaged the valve drive sleeve 10 will not move, and ball valve 6 will remain closed. The valve and radial drive sleeve dogs 16, 17 are thus returned to their initial position [Position A].

FIG. 4B shows the position of the valve indexer profile (18) set on the mandrel 15 (and FIG. 4Bii shows the profile itself). The radial drive sleeve 13 is set into the indexer 18 via valve index in (19). The mandrel 15 is limited to longitudinal movement only, with the extent of its movement being limited by end stop (20) on the radial drive sleeve. As the mandrel moves longitudinally the index pin 19 will traverse the profile of the indexer 18, which defines the rotational movement of the drive sleeve.

The longitudinal movement of mandrel 15 is governed by the profile of the mandrel indexer (21). FIG. 4D shows the mandrel indexer sleeve (22) set between the upper ends of the main housing 2 and the mandrel. The sleeve is free to rotate on the mandrel but is restricted from moving longitudinally by mandrel shoulder (23) and main housing shoulder (24). Therefore the sleeve can only move longitudinally in step with the mandrel. Movement of the mandrel is created by a differential pressure, but the extent of its movement will be governed by the profile of the mandrel indexer defined on the mandrel index sleeve 22. When the mandrel and its index sleeve are caused to move longitudinally the mandrel index pin (25) locked to the main housing 2 will traverse the mandrel indexer profile 21. The free rotation of the sleeve 22 will ensure that only longitudinal movement of the mandrel is controlled by the indexer 21.

The operation of the dual valve system is controlled by movement of mandrel 15, which is caused to move longitudinally by the application of differential pressures across the mandrel piston (26; FIG. 4C). The differential pressures are created between a higher applied annulus pressure and a lower "reference" pressure (this is established within the tool by the Constant Pressure Reference Tool shown in the test string below the Resettable Safety Circulating Valve in FIG. 1). This "reference" pressure is supplied to the Resettable Safety Circulating Valve via reference flow path (27) to spring chamber (28), as shown in FIG. 4B and 4C. The spring (29) in the spring chamber 28 is pre-set to a compression equivalent to about 3000 pounds force. The spring is locked between main housing point (30) and mandrel lock (31) with the upper end of the mandrel being held by main housing shoulder 24.

Between mandrel lock 31 and the mandrel piston 26 is a hydraulic oil chamber (32). At the bottom of the chamber 32 is a hydraulic delay (33) which incorporates a hydraulic restrictor (34) and a non-return valve (35). Both the lock 31 and the piston 26 are in fixed positions relative to the mandrel. The hydraulic delay 33 is fixed in a position relative to the main housing 2. In its initial state, and prior to running in the well, the hydraulic chamber 32 is filled with silicone oil at atmospheric conditions. The upper face of the piston 26 is in communication with the annulus via annular flow path (36) and annulus port (37). FIG. 4C also shows the initial positions of the mandrel sleeve port (38) and circulating ports 37. Once the use of the circulating valve has been selected the mandrel will move downwards sufficiently for the sleeve port 38 and the circulating ports 37 to line up and so establish full communication between the annulus and the tubing bore 1.

Prior to running the tool in the well it is set up as indicated in FIGS. 4A to 4D. The ball valve 6 is closed and the valve index pins 19 and mandrel index pins 25 are in-their initial positions 1A and 1B as shown in FIGS. 4Bii and 4Dii. The valve and radial drive sleeve dogs 16, 17 are engaged in initial position A as shown in FIG. 6.

The operation of the Resettable Safety Circulating Valve is now described.

The tool is run in the hole in conjunction with the Constant Pressure Reference Tool as shown in FIG. 1, As the test string is run downhole the hydrostatic pressure will increase. However "reference" pressure supplied by the Constant Pressure Reference Tool and the annulus pressure remain equal at hydrostatic, so pressure differences are created in the tool and the spring forces of 3000 pounds will remain. The mandrel 15 will not be able to move until hydrostatic plus applied pressure overcomes the hydrostatic pressure plus spring force. Therefore all remains at initial position.

Once at depth the test spring is stabbed into the packer assembly. At this point the "reference" pressure in the Constant Pressure Reference Tool equals the bottom hole hydrostatic pressure, and therefore the pressures in the reference flow path 27 and the annular pressure flow path 36 are equal at hydrostatic. To trap the hydrostatic "reference" pressure in the Constant Pressure Reference tool it is now necessary to apply an annulus pressure at the surface circa 500 to 1000 psi, This applied pressure will not only trap the "reference" pressure but also set the Resettable Safety Circulating Valve into operation.

At this time the pressure in the reference flow path 27 will equal hydrostatic. The upward force on the mandrel lock 31 will equal hydrostatic plus spring force, while the downward force will now equal hydrostatic plus applied pressure across the upper face of the mandrel piston 26. The surface area of the upper face of the mandrel piston 26 is in excess of 6.3 sq ins, and therefore an applied annulus pressure of about 500 psi will exceed the upward spring force of about 3000 lbs. This downward force transmitted through the silicone oil will act on the upper force of the mandrel lock 31. The downward force will now exceed the upper force, and the mandrel will be forced downwards further compressing spring 29 in spring chamber 28.

As the mandrel moves longitudinal downwards a number of events will take place. Initially, silicone oil will be forced around the hydraulic delay 33 between the delay 33 and the mandrel, and the valve indexer 18 and mandrel indexer 21 will also move downwards causing traverse of the valve index pin 19 and mandrel index pin 25 in the profiles.

In the case of the valve indexer 18 the valve index pin 19 will move from its initial Position 1A towards Position 2A. In the case of mandrel indexer 21 the mandrel index pin 25 will move from its initial Position 1B towards Position 2B. During the movement of the valve index pin between points 1A and 2A the longitudinal movement of the mandrel will be translated to rotational movement of the radial drive sleeve 13. As shown in FIG. 6, this right hand movement of the radial drive sleeve will move the valve drive sleeve 10 in the same direction since the valve and radial drive sleeve dogs 16, 17 are engaged and the sequence is moving from Position A to Position B. This rotational movement of the valve drive sleeve 10 will in turn be translated to downward longitudinal movement of the valve cage 3 and the downward movement of the cage will start to open the ball valve 6.

During the mandrel's downward movement the silicone oil in chamber 32 will continue to be forced past the hydraulic delay 33 and the mandrel, This will continue until the mandrel restrictor 40 reaches the delay 33 and seals off the channel between the delay and the mandrel. At this point the silicone oil in the chamber 32 will be forced through the non-return valve 35, so allowing the mandrel to continue downwards, further compressing spring 29 in spring chamber 28.

With the applied annulus pressure of about 500 psi the mandrel will continue to move downwards until mandrel index pin 25 traverses to position 2B on the mandrel indexer profile 21. By this time valve index pin 19 will have traversed to position 2A on the valve indexer profile, and as it does so the radial drive sleeve 13 will rotate 90° to the right. Engagement of the drive dogs will also have ensured that the valve drive sleeve 10 will be rotated 90° to the right. Transfer of this rotational movement to a longitudinal movement of the ball cage 3 via valve drive pins 12 valve drive slots 11 will open ball valve 6 (Position B in FIG. 6).

The mandrel can now no longer move downwards since its movement is restricted by the position of mandrel index pin 25 in the mandrel indexer 21 (Position 2B).

The ball valve 6 is now open—the circulating valve 39 remains closed—and allows the flow of fluids through the tubing bore 1 of the tool.

The applied annulus pressure of about 500 psi is now bled off at surface, and the pressure exerted on the upper face of the mandrel piston 26 via annulus flow path 36 and annulus port 37 returns to equal hydrostatic pressure only. At this point the downward force exerted on the mandrel lock 31 equals hydrostatic pressure only, and so the mandrel is forced upwards, the valve and mandrel indexer profiles 10 and 21 respectively moving with it. Silicone oil in the chamber 32 is forced back through the gap between the delay 33 and the mandrel. The valve index pin 19 will effectively traverse the valve indexer profile 18 (although really it will be the profile that is moving), and move from Position 2A to 3A. During this upward longitudinal movement of the mandrel the travel of the pin 19 in the profile 18 will cause the radial drive sleeve 13 to move rotationally to the left.

At the same time, the mandrel index pin 25 will effectively traverse the mandrel indexer profile 21 (although again it will be the profile that is moving in unison with the mandrel). Movement will be from Position 2B to 3B, and when the mandrel index pin 25 reaches Position 3B the mandrel will be restricted from further upward movement. By this time the valve index pin 19 will have reached Position 3A on the valve indexer profile 18 and the radial drive sleeve 13 will have rotated back to the left to engage the valve drive sleeve 10 and hence reach Position C (FIG. 6). During the latter stages of the movement the mandrel restrictor 40 will move up to seal off the space between the delay 33 and the mandrel. The silicone oil in chamber 32 is now forced through the restrictor 34 but has no effect on the tool operation.

At this point the applied annulus pressure has been bled off, and the ball valve 6 remains in the open position. The valve index pin 19 is located at Position 3A on the valve indexer profile 18, and the mandrel indexer pin 25 is located at Position 3B on the mandrel indexer profile 21. The circulating valve 39 remains in the closed position. When it becomes necessary to close the ball valve 6, i.e. to shut in the well and isolate the formation fluids from the tubing bore 1, a further 500 psi is applied to the annulus from surface.

As previously, the downward force exerted on the upper force of the mandrel lock 31 will exceed the upward force [spring force] exerted on the lower face of the mandrel lock 31 , and the mandrel will be forced downwards, compressing further spring 29 in chamber 28. At this point mandrel index pin 25 begins to traverse mandrel indexer profile 21 from Position 3B towards Position 4B. Once Position 4B is reached then the mandrel will be restricted from any further longitudinal movement.

At the same time, valve index pin 19 begins to traverse valve indexer profile 18 from Position 3A towards Position 4A. This movement will be translated into a rotational movement of the radial drive sleeve 13, and it will begin to rotate to the left. Since the valve and radial drive sleeve dogs 16, 17 are already engaged then this rotation to the left of the radial drive sleeve 13 will cause the valve drive sleeve 10 also to rotate in the same direction. This rotation of the valve drive sleeve 10 will be translated to a longitudinal movement of the valve cage 3, tending to pull the cage upwards, back towards its original position, and hence start to close ball valve 6.

As previously the silicone oil in the chamber 32 will be forced past the delay 33 as the mandrel continues to be forced downwards. Once the mandrel restrictor 40 seals off the delay/mandrel gap, the silicone oil will be forced through the non-return valve 35 and the mandrel will continue on its downward movement. Once the mandrel index pin 25 has reached Position 4B in the mandrel indexer profile 21 and the valve index pin 19 has reached Position 4A in the valve indexer profile 18 the mandrel will be restricted from further movement, and the radial drive sleeve 13 will have rotated a full 90° to the left. This will also have ensured that the valve drive sleeve 10 will also have rotated 90° to the left, which is sufficient to move the valve cage 3 back to its original position and fully close ball valve 6. The dog clutch sequence as shown in FIG. 6 will now be at Position D.

The next step will be to bleed off the applied annulus pressure at surface. However at this point a choice exists regarding the mode of operation. Thus, either the bail valve 6 can be recycled to enable a second period of flow from the formation to the surface, in which case the circulating valve will remain inoperative, or the ball valve 6 can be kept in the closed position and the circulating valve opened to establish communication between the annulus and the tubing bore 1.

For instance, in a normal type of well test programme information will be required from a number of flow periods and build ups. In such a case it would be necessary to cycle the ball valve more than once. In another example it may be that the production from a particular hydrocarbon formation is not as expected, and it may be considered that the hydrostatic head of fluid in the tubing bore is not light enough to allow production from the formation to the surface. In such a case it may be decided to lighten the fluid in the tubing bore, and this would be achieved by maintaining the ball valve in the closed position and opening the circulating valve so establishing communication between the annulus and tubing bore, the fluid existing in the tubing bore then being displaced with a lighter fluid such as diesel (or in some cases nitrogen), which is pumped from the surface.

In considering these options, either will require the applied annulus pressure to be bled off at surface. Selection of the option must then be made as soon as the pressure has been released.

In the case of recycling the ball valve once the pressure has been bled off very little has to be done. As before, once the annulus has returned to equal the hydrostatic pressure the upward force on the lower face of the mandrel lock 31 will exceed the downward force on the upper face of the mandrel lock 31. In this case the mandrel 15 is forced upwards, traversing both the valve indexer profile 18 across valve index pin 19 and the mandrel indexer profile 21 across mandrel index pin 25. In this event the valve index pin 19 traverses from Position 4A towards Position 1A, and mandrel index pin 25 traverses from Position 4B towards Position 1B. As previously, as the mandrel is forced upwards the silicone oil in the chamber 32 is forced back between the delay 33 and the mandrel. Once the restrictor 40 seals off this channel the silicone oil will be forced through the restrictor 34 thus slowing up the flow and restricting the movement of the mandrel. Once the restrictor 40 has passed the delay the mandrel will continue its rapid upward travel towards its original position against main housing shoulder 24.

When the mandrel has completed its travel the mandrel indexer pin 25 will have traversed profile 21 to return to its initial Position 1B, and the valve index pin 19 will have traversed profile 18 from Position 4A to return to its initial Position 1A. During the full movement from Position 4A to 1A the radial drive sleeve 13 will rotate a full 90° to the right. Since the valve and radial drive sleeve dogs 16, 17 were not engaged during the movement, the valve drive sleeve 10 will not rotate, and hence will cause no corresponding movement of the valve cage 3. The ball valve 6 therefore remains in the closed position.

The dog clutch sequence as shown in FIG. 6 will now have returned to its initial Position A.

To repeat the ball valve operating cycle the annulus pressure is again increased by 500 psi at surface. If instead of this it was required to operate the circulating valve, the mandrel would not have been allowed to complete its upward travel and return the mandrel index pin 25 and valve index pin 19 to their original Positions 1B and 1A respectively. So instead of allowing the silicone oil to pass through the hydraulic restrictor 34, and the mandrel restrictor 40 to pass beyond the hydraulic delay 33, a further application of 500 psi annulus pressure is provided from surface. Since the fluid delay can take between 5 and 10 minutes there is sufficient time to apply the annulus pressure. Therefore, as long as the pressure is applied in time the upward travel of the mandrel will be arrested, and since an imbalance again occurs across the mandrel lock 31 in favour of the downward force the mandrel will be forced downwards. In this case the mandrel index pin 25 will traverse between Position 4B and 5B, and once at Position 5B the mandrel will be restricted from further movement. During this movement of the mandrel the valve index pin 19 will move freely in the track of the valve indexer profile 18 between Positions 1A and 4A.

This position of the mandrel allows the integrity of the tubing to be pressure tested prior to opening of the circulating sleeve 39. Following this, the applied annulus pressure of 500 psi is bled off at the surface. The mandrel is then forced downwards for a short distance governed by the traverse of the mandrel index pin 25 in profile 21 between Positions 5B and 6B. The valve index pin 19 will traverse briefly along profile 18 between Positions 4A and 1A.

To open the circulating sleeve, a further 500 psi is applied to the annulus from surface. Again the mandrel is forced downwards, and will continue its travel towards the shoulder of the radical drive sleeve 13. The mandrel index pin 25 will traverse to Position 7B in the profile 21, while index pin 19 will traverse to Position 5A in the profile 18, and since there is no rotational movement in this section of the valve indexer there will be no rotation of the radial drive sleeve 13, and so the valve drive sleeve 10 and ball valve 6 will be unaffected.

As the mandrel moves downwards the mandrel port 38 will break across sleeve seal 41 and line up with circulating sleeve ports 37. The circulating valve is now open, and communication established between the annulus and tubing 1 above the closed ball valve. This now allows fluids in the tubing bore and annulus to be displaced from surface to change fluids prior to continuing the test programme or pulling the string out of the hole.

Positions 8B, 9B, 10B and 11B in the mandrel indexer profile 21 allow for any possible reductions in the applied annulus pressure. For example, if for any reason the applied annulus pressure declined to a point where the spring force was the dominant force, and these positions were not available, the mandrel would automatically travel upwards, full travel, and close off the circulating valve. This would not be acceptable, since such an occurrence could lead to a major pressure build up if the circulating valve suddenly closed while pumping fluids from surface.

Once circulation has been completed the circulating sleeve 39 can be closed. Prior to closing it is essential to ensure that the mandrel index pin 25 is at Position 11B on the mandrel indexer profile with an applied pressure of 500 psi on the annulus.

When the annulus pressure of 500 psi has been bled off at the surface the spring force again will be the dominant force, and the mandrel will be forced upwards. As previously, silicone oil in the chamber 32 will be forced around the delay 33 as the mandrel continues its upwards progress. Mandrel port 38 will move out of alignment with circulating sleeve ports 38, across seal sleeve 41, and the circulating sleeve will be closed.

Mandrel index pin 25 will traverse from Position 11B to 3B on the profile 21, while valve index pin 19 will traverse from Position 5A to a point between Positions 4A and 1A. This will cause a rotational movement of the radical drive sleeve 13, but since this rotation is to the right, and the valve and radial drive sleeve dogs 16, 17 will not be engaged, the ball valve 6 position is not altered—i.e., the ball valve remains closed.

So, both ball valve and circulating valve are now closed.

To complete the cycle and return the mandrel to the initial position, annulus pressure of 500 psi is again applied to the annulus from surface. Mandrel index pins 25 will traverse from Position 3B to 4B on the profile 21, and valve index pins 19 will traverse back to Position 4A on profile 18. This will cause a rotational movement of the radial drive sleeve 13, but since this rotation is now to the left the movement will only re-engage the valve and radial drive sleeve dogs 16, 17, returning dog clutch sequence to Position D.

With the mandrel 15 is this position, governed by Position 4B on the mandrel indexer profile, the integrity of the seal 41 of the closed circulating valve can be checked.

Finally the annulus pressure is bled off at surface. The spring again becomes the dominant force, and the mandrel is forced upwards. Mandrel index pins 25 traverse profile 21 back to the original Position 1B via the hydraulic restrictor 34 (if for any reason it is necessary to re-open the circulating valve at this stage, further annulus pressure can be applied before the delay is completed). At the same time, valve index pins 19 traverse profile 18 back to the original Position 1A. This movement causes rotation of the radical drive sleeve 13, but since the rotation is to the right no rotation of the valve drive sleeve 10 occurs, and the dog clutch sequence returns to Position A as shown in FIG. 6 (i.e., the original position). The full sequence has now been completed, and further operation of the ball valve and circulating valve can be carried out by repeating the sequence as described herein.

The invention also includes a unique and novel method of monitoring annulus overpressure, and provides a fail safe method for ensuring that both valves are in the fail safe position—ball valve closed and circulating valve open—if the annulus pressure should exceed a predetermined level (e.g. 4000 psi). The device incorporates a shear pin system (42) on the mandrel index sleeve 22. This mandrel index sleeve 22 is able to rotate freely on mandrel 15 but is caused to move longitudinally in unison with the mandrel bound between mandrel shoulder 23 at its lower end and by the sheer pin system 42 at its upper end. As and when the annulus pressure increases above the standard 500 psi applied pressure the differential pressure across mandrel lock 31 will increase causing the mandrel to move further downwards. As this occurs the movement of the mandrel will normally be restricted by the mandrel index pin 25 reaching any of the following positions in the mandrel indexer profile 21:

2B, 4B, 5B, 7B, 9B or 11B.

As the annulus overpressure approaches the predetermined level, the force exerted by the pins 25 on the limit points in the indexer 21 will exceed the shear rating of the shear pin system 42. The shear pins will shear, and the mandrel index sleeve 22 will be released from the mandrel. The mandrel is now free to travel downwards fully to the end stop on the radial drive sleeve 13. When this occurs the valve index pin 19 will be free to travel to Position 6A on the valve indexer profile 18 regardless of its position prior to the overpressure sequence.

If for instance the valve index pins 19 were at Position 3A on the valve indexer profile 18 the free movement would cause the pins 19 to traverse the indexer 18 to Position 6A via 4A and 5A. The initial movement from 3A to 4A would cause rotational movement of the radial drive sleeve 13 and the valve drive sleeve 10, which would cause longitudinal movement of valve cage 3 closing ball valve 6. Similarly, if the valve index pins 19 were at Position 2A on the indexer 18 the free movement would traverse pins 19 to Position 6A via 5A. Such a movement would again cause rotational movement of the radial and valve drive sleeves 13 and 10 and so close ball valve 6.

For any other position—i.e. 1A, 4A and 5A—the ball valve will already be closed.

So this overpressure shear of the mandrel index sleeve 22 will automatically cause the ball valve to close and the circulating valve to open simply by allowing free and full downward movement of the mandrel, and this will be achieved regardless of tool status prior to the annulus overpressure.

The Resettable Safety Circulating Tool described above is run in as an integral part of a Drill Stem Test (DST) tool. The version now described, however, can be used as an adjunct to a DST tool, and is run in conjunction with, for example, the Subsurface Control Valve and the Single Ball Circulating Valve. It can be run at any required depth above the other DST tools, though usually a few hundred feet above, separated from the lower tools by a section of Drill Collars. It will normally be separate from any Gas Reference Pressure system in the DST tools, and so needs its own internal reference pressure for operation (thus it is provided with communication to a Constant Pressure Reference Tool).

In this configuration the second version is only used if and when required—for instance, to circulate out hydrocarbon fluids from the test string above the tool or to replace the fluid column with alternative fluids such as diesel, nitrogen and water in order to provide a lighter hydrostatic column in the test string. Accordingly, the main test programme, requiring multiple flowing and shut-in periods, would be carried out by operation of the Subsurface Control Valve. During such periods the resettable safety circulating tool would need to remain inactive and only be activated when other more specific operations are required (such as those mentioned above. It is essential therefore that the tool is not activated by annulus pressures which are applied to operate some other part of the DST tool—the Subsurface Control Valve, say. As explained in more detail hereinafter, the design of the mandrel indexer profile (21R) ensures that this second version can only be activated if and when required, and if initiated by a pre-determined sequence of annulus pressure pulses.

The design of the valve indexer and the other tool sections are virtually as for the first version described hereinbefore. The difference between the two versions lies primarily in the design of the mandrel indexer (discussed further below), coupled with the initial valve configuration (in the case of the second version the tool is run in with the ball valve in the open position [closed in the first version] (the circulating valve is in the closed position, preventing annulus/tubing, as in the first version).

A summary of the operation of this second version is now given with reference to FIGS. 4A to 4D coupled with FIGS. 4Biii and 4Diii (these are the second version's valve indexer and mandrel indexer respectively, and take the place of the first section's indexers as shown in FIG. 4Bii and 4BDii).

Basically, a description of the second version is much the same as that of the first version, with the exception of the mandrel indexer profile and the initial position of the ball valve (valve cage 3 now at the lower limit of its travel against mandrel end stop 4). The operation of the tool differs considerably, however, because of the changes to the mandrel indexer profile. A s stated previously it is essential that annulus pressures applied to operate the Subsurface Control Valve do not activate the resettable safety circulating tool (RSC tool), for during a standard test programme when annulus pressures are applied to the Subsurface Control Valve these same pressures would also be applied to the upper face of mandrel piston 26 via annular port 37. As explained below, this can be prevented from activating the RSC tool, where Positions 2R, 3R and 4R are simply to permit initialisation of the tool—i.e., until Position 5R has been attained no mechanical change to either of the RSC tool's valves will occur (thus, the ball valve remains open, and the circulating valve stays closed). Thus, the Subsurface Control Valve (or any other secondary annulus-controlled tool), can be operated as many times as is necessary without causing the RSC tool to operate.

The details of this version's operation are now described.

The initial state of the tool is with the ball valve open and the circulating valve closed, with the mandrel 15 at the top of its travel and both mandrel and valve index pins 25 and 19 in their initial Positions 1R and 1 in the mandrel and valve indexers 21R and 18 respectively. When the tool is required to function a series of pressure pulses, each of about 500 psi, are applied to the annulus from surface.

The first pressure application will force the mandrel 15 to move downwards, its movement being curtailed once mandrel index pin 25 travels from its initial Position 1R to Position 2R on the profile of mandrel indexer 21R, This longitudinal movement of the mandrel will cause valve index pin 19 to travel from Position 1 to Position 2 on the valve indexer 18 which in turn causes radial drive sleeve 13 to rotate. Since the direction of the rotation does not cause the drive sleeve dogs 16, 17 to engage then the valve drive sleeve 10 will not rotate and hence there is no change to the position of the ball valve 6 [i.e. ball valve remains open].

When the applied annulus pressure is bled off at surface and the spring force becomes the dominant force in the tool the mandrel is forced to move upwards. Mandrel index pin 25 will travel from Position 2R towards Position 1R [along the dashed track]. The silicone fluid will be metered through the delay restrictor 34, and if no further annulus pressure pulse is applied then the mandrel will return to its original position—i.e., mandrel index pin 25 back to Position 1R in mandrel indexer 21R. However, a second application of annulus pressure before fluid has been metered fully through the delay restrictor 34 will ensure that the mandrel is forced downwards, and mandrel index pin 25 will travel to Position 3R on mandrel indexer 21R. Again, bleeding off this applied annulus pressure will force the mandrel to move upwards, tending to cause mandrel index pin 25 to travel from position 3R towards Position 1R [along the dotted track]. But a third application of annulus pressure before fluid has again been metered fully through the delay restrictor 34 will cause the mandrel again to move downwards, mandrel index pin 25 moving to Position 4R on mandrel indexer 21R.

During these three applications of applied pressure from surface the valve index pin 19 has been travelling back and forth between Positions 1 and 2 on the valve indexer 18, governed by the movements of the mandrel 15, and during these pin movements radial drive sleeve 13 has been rotating—but since the direction of the rotation does not cause the drive dogs 16, 17 to engage, the valve drive sleeve 10 will not rotate, and hence there will have been no change to the position of the ball valve 6 [i.e., the ball valve remains in the open position]. This set-up changes with a fourth application of annulus pressure while the mandrel is still moving back—via the delay—to its initial position.

When the third applied pressure is bled off the mandrel again moves upwards, and mandrel index pin 25 travels from Position 4R towards Position 1R on the mandrel indexer 21R. A fourth application of annulus pressure at surface before the fluid has been fully metered through the delay restrictor 34 will cause the mandrel to move downwards and mandrel index pin 25 to travel to Position 5R on the mandrel indexer 21R. This time the downward movement of the mandrel will be further than in the previous operations, and valve index pin 19 will travel to Position 3 in the valve indexer 18, causing further rotation of the radial drive sleeve 13. However, since drive dogs 16, 17 are still not engaged there will be no resultant rotation of the valve drive sleeve 10, and hence the ball valve 6 will remain open.

When this fourth application of annulus pressure is bled off the mandrel will move upwards, and mandrel index pin 25 will travel from position 5R to position 6R. At this point the profile will not allow travel of the pin 25 back to Position 1R via the delay restrict 34, and the tool has now been activated; further pressure applications will now operate the valves in a predetermined sequence. The valve index pin 19 will have travelled to position 4 on the valve indexer 18. Rotation of the radial drive sleeve 13 will, at the end of the pin's travel, engage the drive dogs 16, 17. However, at this point the ball valve 6 will still remain open.

A fifth application of annulus pressure at surface will move the mandrel downwards, and mandrel index pin 25 will travel from Position 6R to Position 7R, while valve index pin 19 will travel from Position 4 to Position 5. the subsequent rotation of the radial drive sleeve 13 will, via engagement of the drive dogs 16, 17, cause rotation of the valve drive sleeve 10, and hence longitudinal movement of valve cage 3. This will close ball valve 6. So at this point both the ball valve and the sleeve are closed.

Bleeding off the annulus pressure will cause the mandrel to move upwards, mandrel index pin 25 to travel to Position 8R, and valve index pin 19 to move to Position 5A. No rotation of the radial drive sleeve 13 will yet occur.

A sixth application of annulus pressure at surface will again move the mandrel downwards, and mandrel index pin 25 will travel to Position 9R. This additional downwards travel of the mandrel will align mandrel ports 38 and annular port 37, and the circulating valve will be open, allowing communication between the annulus and tubing. At the same time, valve index pin 19 will travel to Position 6 on the valve indexer 18, but there will be no rotation of the radial drive sleeve 13. Therefore at this point the ball valve is closed and the circulating valve is open. This will allow circulating operations to be carried out—i.e., circulating out fluid contents in the test string above the RSC tool and replacing with alternative fluids.

Positions 10R, 11R 12R and 13R on the mandrel indexer profile 21R allow for indeterminate fluctuations in the annulus pressure during circulation, and ensure that a drop in the annulus overpressure below 500 psi will not cause the circulating valve to close.

Following completion of the circulating requirements the annulus pressure will be at about 500 psi, and the mandrel index pin 25 will be at position 13R on the mandrel indexer 21R. Once this annulus pressure has been bled off at the surface the mandrel will move upwards, and mandrel index pin 25 will travel to Position 14R. During the movement of the mandrel the mandrel ports 38 and the annular port 37 will become misaligned, and therefore the circulating valve will now be closed. The valve index pin 19 will travel back to Position 5A on the valve indexer 18, but again there will be no rotation of the radial drive sleeve 13. Therefore at this point the ball valve and the circulating valve are both closed.

A seventh application of applied pressure at surface will move the mandrel downwards, and mandrel index pin 25 will travel to Position 15R. This operation allows a check on the integrity of the seal of the closed circulating valve—i.e., no communication between annulus and tubing. At the same time, the valve index pin 19 will travel to position 5 on the valve indexer 18 without causing radial drive sleeve 13 to rotate.

Bleeding off this applied annular pressure will cause the mandrel to move upwards, and mandrel index pin 25 will travel to Position 1R or the mandrel indexer 21R—its original position. The valve index pin 19 will travel simultaneously to Position 1 on the mandrel indexer 18—its original position. During this travel the radial drive sleeve 13 will rotate, but in a direction which does not engage the drive dogs 16, 17 and hence causes no movement of valve drive sleeve 10 and the ball valve 6. However, at the end of the travel the drive dogs 16, 17 will become engaged.

So at this point the ball valve and circulating sleeve are both still closed.

To re-open the ball valve, and return the tool to its initial state, it is necessary to apply a further annulus pressure of about 500 psi. This applied annulus pressure will cause the mandrel to move downwards, and mandrel index pin 25 to travel from Position 1R to Position 2R. Valve index pin 19 will travel from Position 1 to Position 2 on valve indexer 18, which causes radial drive sleeve 13 to rotate. Now that the drive dogs 16, 17 are engaged the direction of rotation of the radial drive sleeve 13 will cause rotation of the valve drive sleeve 10, and a corresponding longitudinal movement of valve cage 3 and hence ball valve 6 is opened. Bleeding off the annulus pressure allows the mandrel to move upwards, and mandrel index pin 25 to travel back to its original position 1R.

At this point the ball valve is open and the circulating sleeve is closed and all components of the tool have returned to their original positions.

If it had been required to re-open the circulating sleeve instead of re-opening the ball valve a further annular pressure could have been applied before fluid had been fully metered through delay restrictor 34, and hence mandrel index pin 25 would have travelled Position 3R instead of back to Position 1R. Additional pulses of annulus pressure would then have taken the tool back through its pre-determined sequence governed by the profile of the mandrel indexer 21R from Positions 3R through 15R. In this way the RSC tool could be sequenced as many times as would be required before returning to its inert status. Once back to its inert state the other DST tools in the string could be re-activated if required by relevant application of annulus pressure.

I claim:

1. An apparatus used to independently control the operation of devices in a completion system string, the operation of the devices being effected by the relative movement of two members of the completion system string, the apparatus comprising:

a) a first member which constitutes a first defined portion of the completion system string;

b) a second member, proximate the first member, which constitutes a second defined portion of the completion system string;

c) a J-slot indexer, the indexer including first and second pre-defined closed-loop tracks attached to the first member, each of said tracks including a section of track in common with the other, each of said tracks following a predetermined path, and a track-following part attached to the second member which is constrained to continuously follow one or the other of the tracks;

d) track selection means which interacts with the members for routing the track-following part into a selected one of said pre-defined closed-loop tracks;

e) means for moving at least one of said members, wherein the J-slot indexer controls the relative movement between the two members in a pattern which corresponds to the pre-defined path of the selected track, thereby controlling the operation of the devices, and wherein said relative movement in a pattern according to the common section of track does not effect operation of said devices;

f) a first device, the operation of which is effected by the relative movement of the two members in a pattern corresponding to the first of said tracks; and g) a second device, the operation of which is effected by the relative movement of the two members in a pattern corresponding to the second of said tracks and in a general direction different from the general direction of relative movement of the two members determined by the first of said tracks.

2. The apparatus according to claim 1, wherein the first device is a main tubing ball valve and the second device is a circulation valve.

3. The apparatus according to claim 1, wherein the means for moving the members includes a means for interjecting a change in the pressure differentials between an interior space of the completion system string and the annular space surrounding it in the well.

4. The apparatus of claim 3, wherein the second member is a fixed tube of the completion system string and the first member is a tubular mandrel moving within the fixed tube.

5. The apparatus of claim 4, wherein the fixed tube and the tubular mandrel define a pair of annular chambers joined by two passage ways, the first being a restricted passage way and the second having a one-way valve inserted therein.

6. The apparatus of claim 5, wherein the means for interjecting a change in pressure differential initiates annular pressure pulses, each consisting of an incremental and a decremental pressure change.

7. The apparatus of claim 5 further comprising a shear pin release mechanism linked to the mandrel to provide a fail safe operation when the pressure within the annular chambers exceeds a predetermined level.

8. An apparatus used to independently control the operation of devices in a completion system string, the operation of the devices being effected by the relative movement of two members of the completion system string, the apparatus comprising:

a) a first member which constitutes a first defined portion of the completion system string;

b) a second member, proximate the first member, which constitutes a second defined portion of the completion system string;

c) a J-slot indexer, the indexer including first and second pre-defined closed-loop tracks attached to the first member, each of said tracks including a section of track in common with the other, each of said tracks following a predetermined path, and a track-following part attached to the second member which is constrained to continuously follow one or the other of the tracks;

d) track selection means which interacts with the members for routing the track-following part into a selected one of said closed-loop tracks; and e) means for moving at least one of said members, wherein the J-slot indexer controls the relative movement between the two members in a pattern which corresponds to the predetermined path of the selected track, thereby controlling the operation of the devices;

f) a first device, the operation of which is effected by the relative movement of the two members in a first direction around a first of said tracks; and g) a second device, the operation of which is effected by the relative movement of the two members in a second direction opposite the first direction around a second of said tracks, the movement being in the same direction in said common track section.

9. The apparatus according to claim 8, wherein the first direction is generally clockwise and the second direction is generally counterclockwise.

10. The apparatus according to claim 9, wherein the first device is a main tubing ball valve and the second device is a circulation valve.

11. The apparatus according to claim 8, wherein the means for moving the members includes a means for interjecting a change in the pressure differentials between an interior space in the completion system string and the annular space surrounding it in the well.

12. An improved J-slot indexer used to control the operation of a plurality of devices in a completion system string, the operation of the devices being effected by the relative movement of at least two members which comprise at least a portion of the completion system string, the indexer comprising:

a) a first closed-loop track effecting the operation of a first of the devices, the first track associated with a first of said members of the completion system string;

b) a second closed-loop track associated with the first member of the completion system string, the second track having a portion of track common to the first track and disposed in a generally serial arrangement with respect to the first track, the second track effecting the operation of a second of the devices; and c) a track-following part associated with a second member of the completion system string and constrained to continuously traverse the tracks, thereby guiding the relative movement of the two members of the completion system string in accordance with the track traversed by the track-following part.

13. The apparatus according to claim 12, wherein the first device is a main tubing ball valve and the second device is a circulation valve.

14. The J-slot indexer of claim 12 wherein the track-following part traverses the first closed-loop track in a generally clockwise direction and transverses the second closed-loop track in a generally counterclockwise direction.

15. An improved J-slot indexer used to control the operation of a plurality of devices in a completion system string, the operation of the devices being effected by the relative movement of at least two members which comprise at least a portion of the completion system string, the indexer comprising:

a) a first closed-loop track effecting the operation of a first of the devices, the first track associated with a first of said members of the completion system string;

b) a second closed-loop track effecting the operation of a second device, the second track associated with the first of said members and having a portion of track common to the first track;

c) a track-following part associated with a second member of the completion system string and constrained to traverse said tracks, the first closed-loop track including first guide pieces which promote the traversal of the track-following part in a first direction, the second closed-loop track including second guide pieces which promote the traversal of the track-following part in a second direction, whereby the relative movement of the two members of the completion system string is determined by the track traversed by the track-following part.

16. The apparatus according to claim 15 wherein the first device is a main tubing ball valve and the second device is a circulation valve.

17. The J-slot indexer of claim 15 wherein the first guide pieces promote traversal of the track-following part in a generally clockwise direction and the second guide pieces promote traversal of the track-following part in a generally counterclockwise direction.

* * * * *